United States Patent [19]

Wethington

[11] 3,943,027

[45] Mar. 9, 1976

[54] CARPET MACHINE

[75] Inventor: Charles A. Wethington, Spartanburg, S.C.

[73] Assignee: Deering Milliken Research Corporation, Spartanburg, S.C.

[22] Filed: Apr. 8, 1974

[21] Appl. No.: 458,769

[52] U.S. Cl. ..... 156/435; 156/72; 156/178

[51] Int. Cl.[2] ..... D05C 15/04

[58] Field of Search ..... 156/72, 435, 176, 178, 156/436, 202–204, 210, 177, 179, 189, 162, 173; 28/72 P, 1.8; 161/63

[56] References Cited

UNITED STATES PATENTS

| | | | |
|---|---|---|---|
| 1,970,625 | 8/1934 | Reed | 156/204 |
| 2,116,048 | 5/1938 | Smith | 156/435 |
| 2,583,337 | 1/1952 | Laing | 156/435 |
| 3,157,554 | 11/1964 | Beasley | 156/435 |

FOREIGN PATENTS OR APPLICATIONS

| | | | |
|---|---|---|---|
| 1,560,873 | 10/1969 | Germany | 156/435 |

OTHER PUBLICATIONS 2,831,525 04001958 Cole 156 435

*Primary Examiner*—Douglas J. Drummond
*Assistant Examiner*—Michael W. Ball
*Attorney, Agent, or Firm*—Earle R. Marden; H. William Petry

[57] ABSTRACT

Method and apparatus to produce a bonded loop pile carpet. The carpet machine is of the rotary type which uses cooperating blade members to form the yarn loops for bonding to a backing sheet. One set of the blade members is reciprocably mounted in the rotor of the machine. The other blade member is controlled to produce high and low loops.

3 Claims, 10 Drawing Figures

CARPET MACHINE

It is an object of this invention to provide a method and apparatus to efficiently, inexpensively and continuously produce a bonded high-low loop pile carpet.

Other objects and advantages of the invention will become readily apparent as the specification proceeds to describe the invention with reference to the accompanying drawings, in which.

Figure 1:
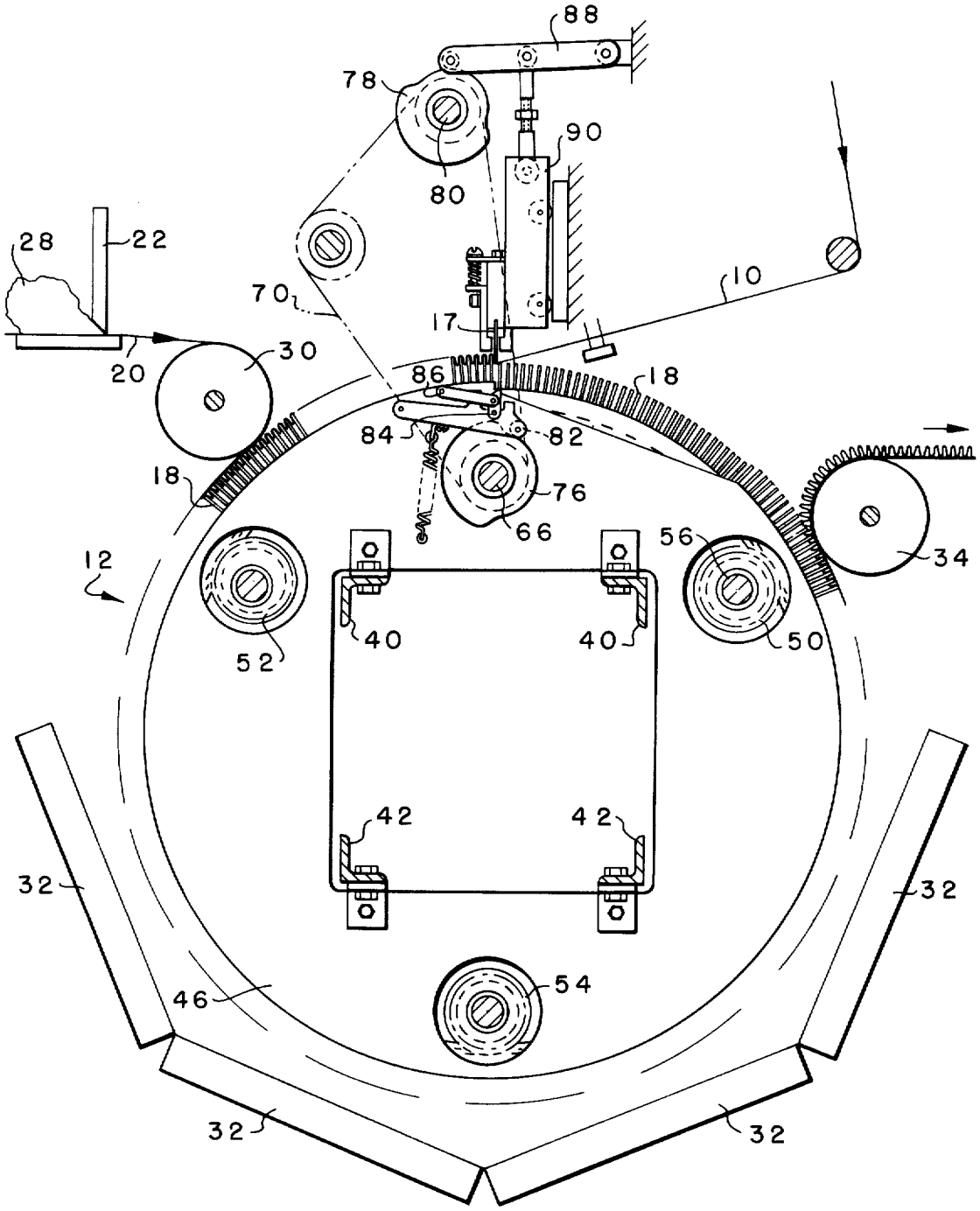
FIG. 1 is a sectional elevation view taken on line 1—1 of FIG. 2.
Figure 2:
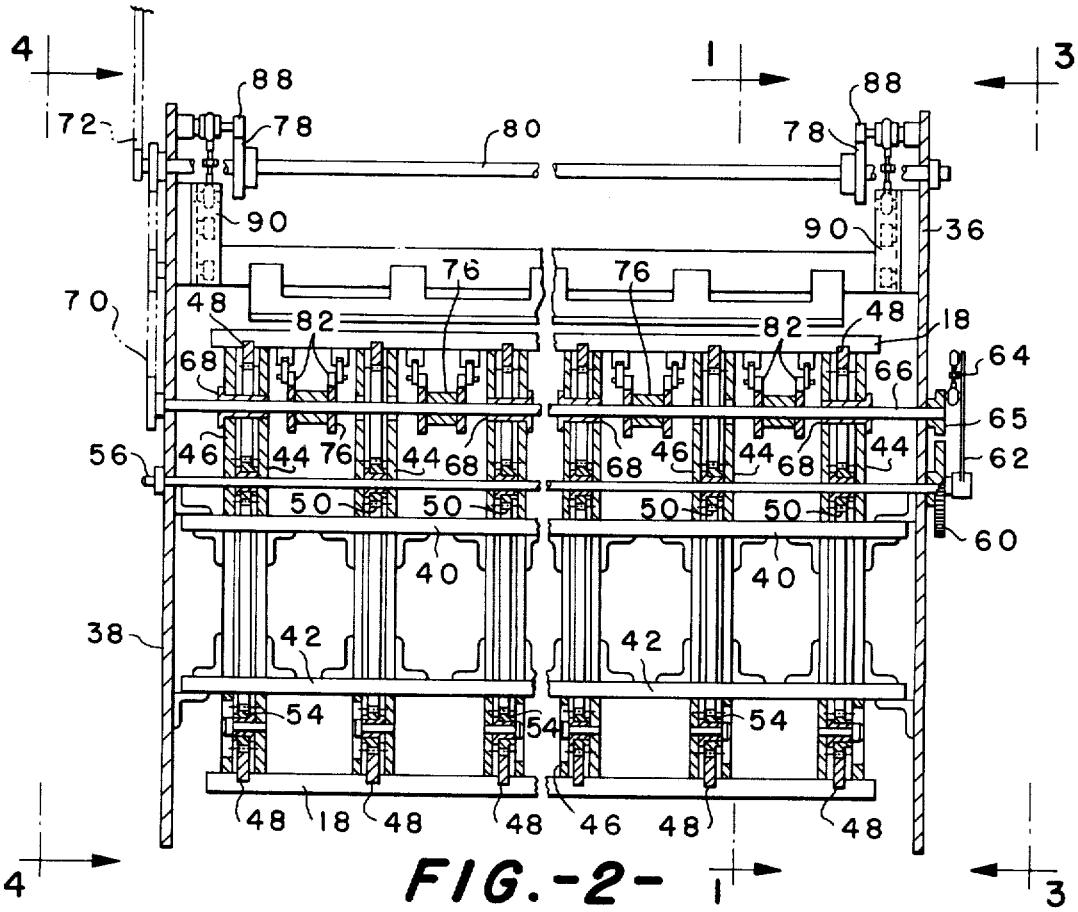
FIG. 2 is a cross-sectional elevation view of the carpet machine rotor.
Figure 8:
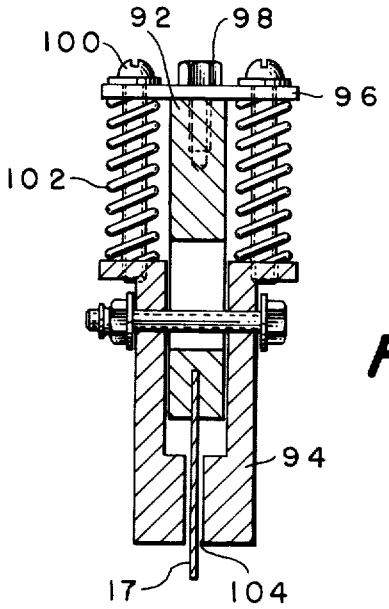
FIG. 8 is a blown-up view of the pressure foot shown in FIG. 6.
Figure 3:
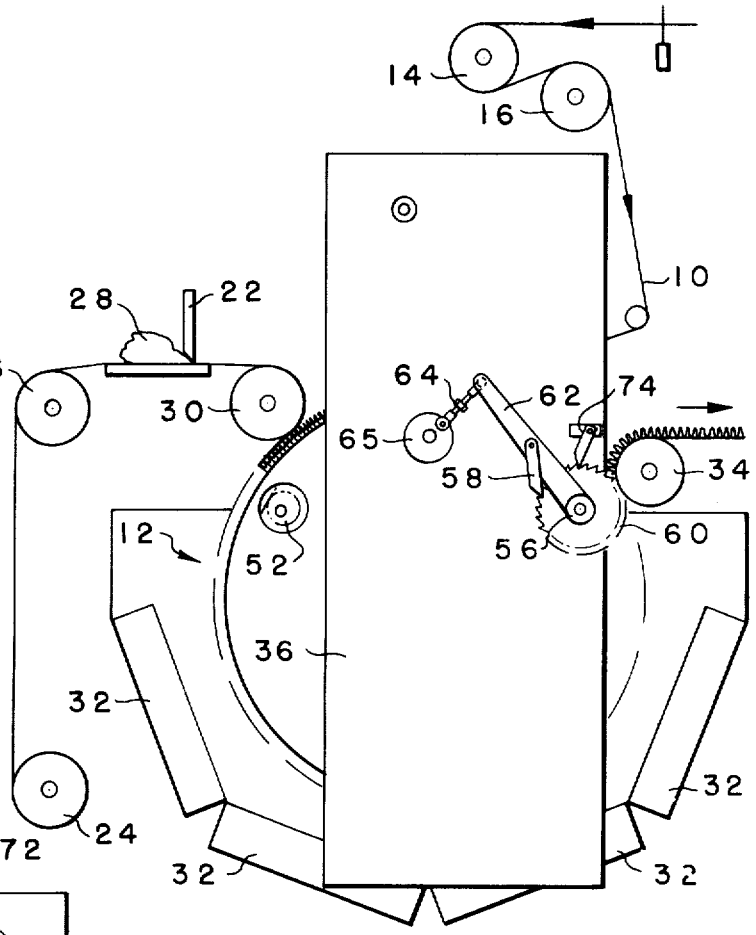
FIG. 3 is an elevation view taken on line 3—3 of FIG. 2.
Figure 4:
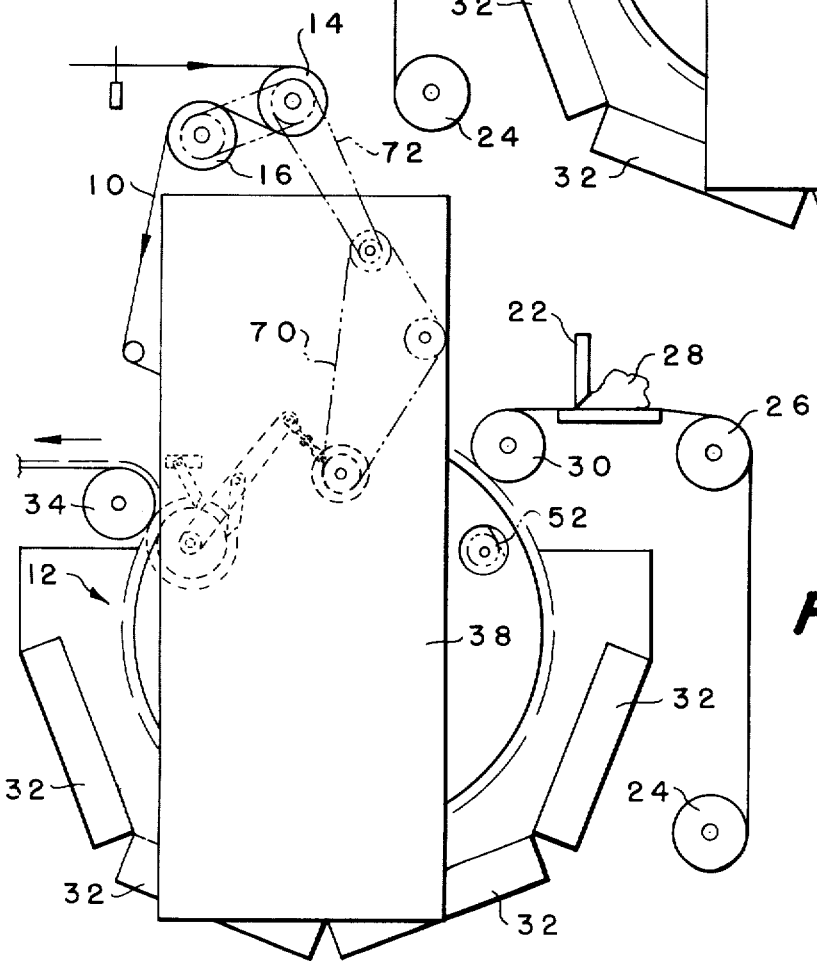
FIG. 4 is an elevation view taken on line 4—4 of FIG. 2.

Looking at FIGS. 1, 3 and 4, the overall concept will be explained. A plurality of yarn ends 10 is supplied from a warp beam or creel (not shown) to the rotor 12 over a pair of rolls 14 and 16. At the rotor, upper blade 17 cooperates with the lower blades 18 to insert the yarn in loops between the lower blades 18. The rotor is rotated counterclockwise and the loops are inserted into a suitable adhesive, such as polyvinyl chloride, placed on a backing sheet 20 by the doctor blade 22. The backing sheet is supplied from a roll 24, over a roll 26 to the adhesive station 28 and then over pressure roll 30 to a position against the top of loops. The backing sheet with the loops thereattached continues to rotate counterclockwise past the infrared electric heaters 32 to set the bond between the loops and the backing sheet. The bonded carpet is then doffed over roll 34 and delivered to the take-up roll (not shown).

The rotor 12 is supported between side plates 36 and 38 by cross-supports 40 and 42 to which are attached a plurality of support plates 44 and 46. Rotably supported between the plates 44 and 46 are blade support rings 48 which are held in position by drive gear 50 and idler gears 52 and 54 which are mounted on one of the plates 44 and 46 and engage the toothed inner surface of the rings 48. Each of the blade support rings 48 has a plurality of notches cut in the outer surface thereof to slidably support the lower blades 18. The lower blades are held in the notches by suitable means such as springs (not shown).

The driven gears 50 are rigidly secured to a rotably mounted shaft 56 which is intermittently rotated by the action of the pawl 58 against the ratchet 60 mounted on one end of shaft 56. The pawl 58 is pivotally mounted and actuated by the crank arm 62 which is rotated by the lever 64 connected to the crank 65. Crank 65 is mounted on shaft 66 supported by bearings 68 in the plates 44 and 46 and is driven by chain 70 which is driven from a drive source (not shown) by chain 72. A second pawl 74 is pivotally mounted adjacent the ratchet 60 to prevent back lash of the ratchet.

Also mounted on the shaft 66 between adjacent pairs of plates 44, 46 are cams 76 to periodically actuate the blades 18. Another set of cams 78 is mounted on shaft 80 which is also driven by chain 70 in timed relation so that the cams 76 and 78 rotate in a one-to-one ratio.

Each of the cams 76 has a pair of spring loaded followers 82 operably associated therewith to slide upwardly one of the lower blades 18 at a predetermined time. The follower causes the pivotally mounted arm 84 to move upwardly to engage the blade 18. Another lever 86 is pivotally connected to cause the arm 84 to move in a substantially perpendicular direction to raise the blade 18 straight up.

Cams 78 are operably associated with a follower arm 88 pivotally connected to the frame of the machine to raise and lower the upper blade holder 90. Mounted to the blade holder 90 is the upper blade support 92 and the presser foot 94. The blade support 92 is secured to the movable plate 96 by means of bolt 98. Bolts 100 project through plate 96 to support the pressure foot 94. Located between the plate 96 and the presser foot 94 around the bolts 100 are compression springs 102 for reasons hereinafter explained. The upper blade 17 is mounted on the end of blade support 92 and projects through the elongated opening 104 in the presser foot.

In the preferred embodiment the rotor 12 is stopped when the blades 17 and 18 are forming the loops and then the rotor is indexed to the next loop forming position but such motion is not mandatory. It is contemplated that the motion of the rotor could be continuous and the blade holder 90 could move therewith in a manner as shown in U.S. Pat. No. 3,385,747 wherein the motion of the top blade is synchronized with the motion of a rotor by having the angular velocity of the blade holder equal to the angular velocity of the rotor during a portion of the loop forming period.

Figure 6:
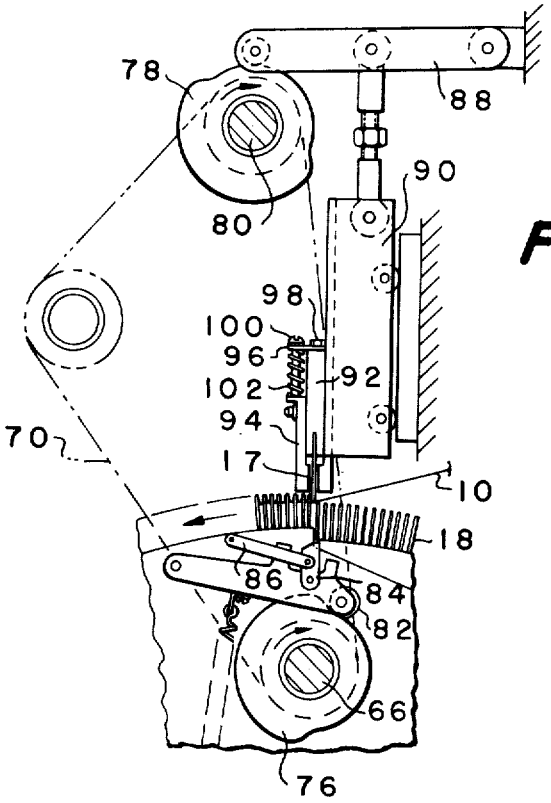
FIGS. 5-7 are blown-up views of the loop forming mechanism showing various stages of loop formation.
Figure 7:
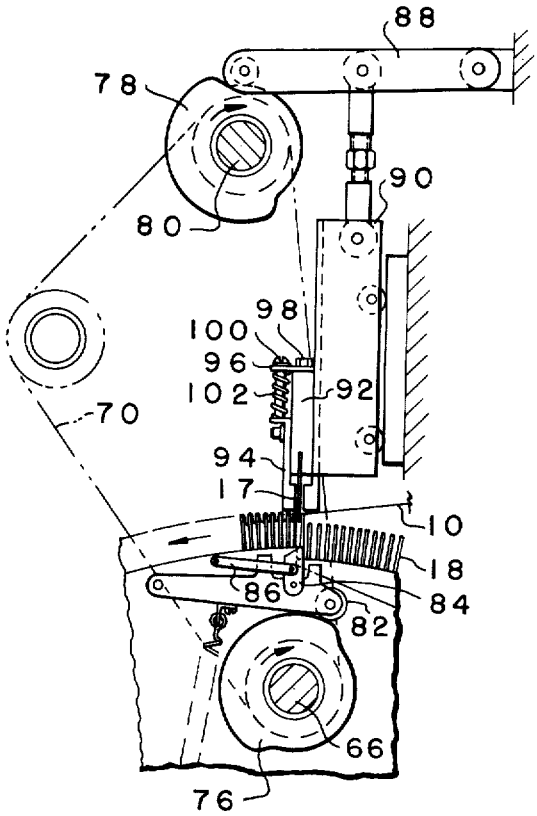
Figure 5:
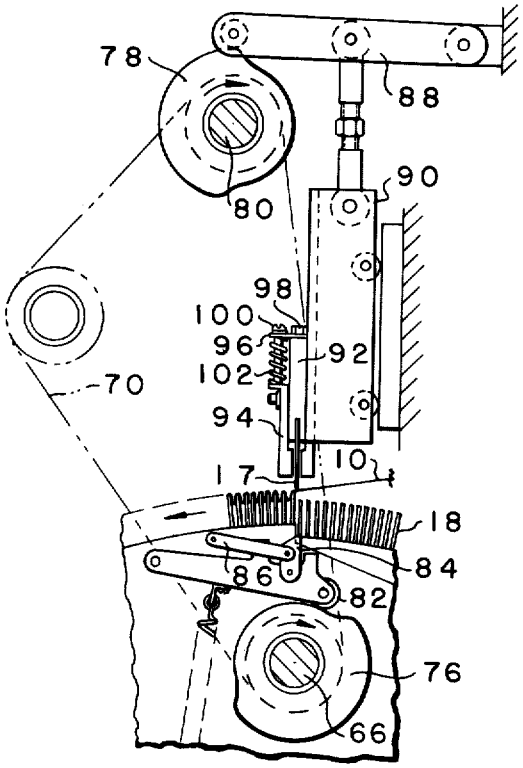

Looking now to FIGS. 5-7 the loop forming operation will be explained. In FIG. 5 the ratchet 58 and pawl 60 have been actuated to rotate the blade 18 to the position indicated. The cam 78 has pivoted the lever 88 to the extreme upward position to hold the blade 17 in its up position. Then as the cams 76 and 78 continue to rotate they assume the position shown in FIG. 6 wherein the upper blade 17 is lowered to bend the yarn downward over one of the blades 18 while the presser foot 94 engages the top of the previously formed yarn loop to prevent it from being pulled out as the blade 17 folds the yarn over the blade 18. Then as the cams 76 and 78 continue to rotate they assume the position shown in FIG. 7 wherein the blade 17 remains in the downward position while the arm 84 is moved upward by the cam 76 to slide the blade 18 upward to form the other half of the yarn loop between adjacent blades 18. Once the yarn loop is formed between adjacent blades 18 the cams 76 and 78, respectively, allow the blade 18 to retract and move the blade 17 upwardly. The blades 18 are once against indexed to the position shown in FIG. 5 and the cycle is repeated.

It should be noted that only half the yarn loop is being formed at any one time, therby reducing the frictional forces on the yarn between the blade 18 and the yarn. This results, necessarily, in a reduction in the amount of force necessary by the blades 17 and 18 to form the yarn loops.

Figure 9:
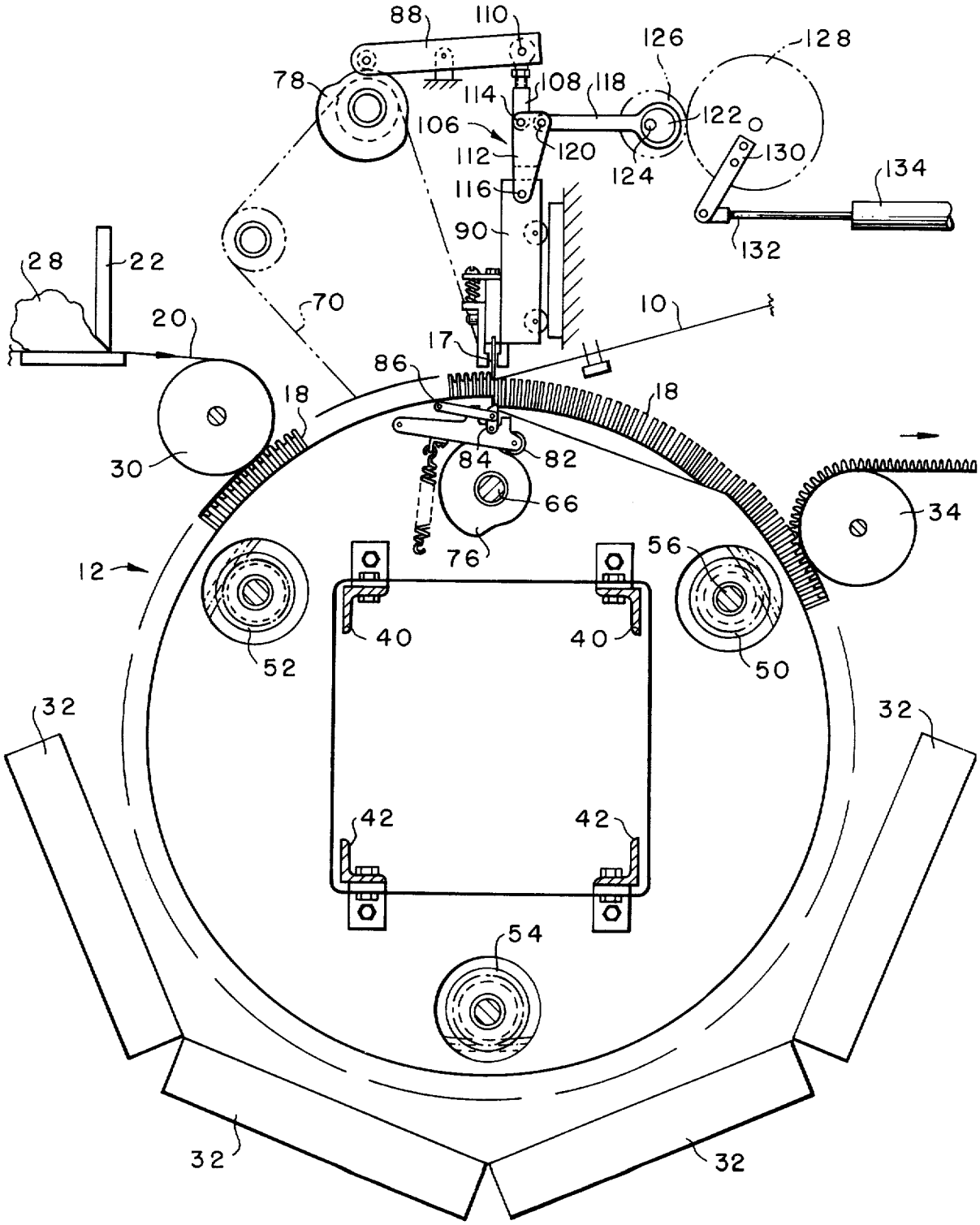
FIGS. 9 and 10 are similar to FIG. 1 showing a modification of the control linkage for the upper blade member.
Figure 10:
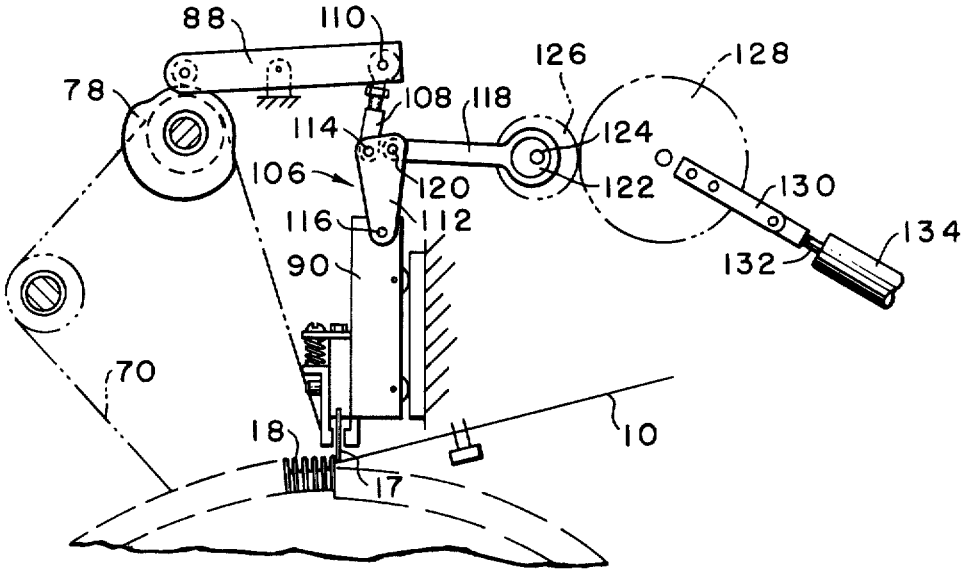

FIGS. 9 and 10 show a modification of the control linkage for the upper blade member 17 to provide capability to produce varying loop heights. As with the apparatus of FIGS. 1-8 the movement of the blade holder is controlled by the cam 78 and the follower arm 88 but the amount of movement is controlled by the position of the linkage 106 between the follower 88 and the blade holder 90. The linkage 106 consists of a linkage 108 pivotally connected at 110 to the follower arm 88 at one end and to the linkage 112 at 114 at the other end. Linkage 112 is also pivotally connected to the blade holder 90 at 116 and crank arm 118 at 120. Crank arm 118 slidably surrounds and is reciprocated by the eccentric 122 mounted on shaft 124. Also connected to shaft 124 is a gear 126 which is in mesh with and positioned by gear 128. Fixed to the gear 128 is a lever 130 pivotally connected to the piston arm 132 of piston 134.

As can be seen the vertical position of the blade 17 depends on the position of the linkages 108 and 112 of the linkage 106. FIG. 9 shows the position of maximum depth of the blade 17 to form a high loop since the linkages 108 and 112 are in axial alignment while FIG. 9 shows the position of minimum depth of the blade to form a low loop. The high-low and intermediate blade positions are controlled by the position of the eccentric 122 which is positioned by the piston 134 acting on the lever arm 130 to position the gears 126 and 128. The control for the piston (not shown) can be of any suitable type and can be programmed to provide for an infinite number of loop heights in an infinite number of patterns so that the modification of FIGS. 9 and 10 provides a simple control of loop height which can provide infinite variations of loop height in the finished product.

Although I have described specifically the preferred embodiments of my invention I contemplate that changes may be made without departing from the scope or spirit of my invention and I desire to be limited only by the claims.

That which is claimed is:

1. Apparatus to produce a bonded pile fabric comprising: a rotor, means to rotate said rotor, a set of blade members slidably mounted in said rotor, a second blade member slidably mounted with respect to said rotor and operably associated with said blade members in said rotor, means to supply yarn between said set of blade members and said second blade member, means to move said second blade downwardly at a predetermined time to bend the yarn over one blade of said set of blades, means to slide upwardly the blade of said set of blades next adjacent to the blade over which the yarn is bent to form a loop in said yarn, means to supply an adhesive backed backing material into contact with said formed loop, means to adjust the amount of downward movement of said second blade, said means to move said second blade downwardly including a cam actuated lever arm, a first linkage pivotally connected to said lever arm, and a linkage means pivotally connected to said first linkage and said second blade member, said means to adjust the amount of downward movement of said second blade member includes a means to pivot said linkage means with respect to said second blade member and said first linkage to change the effective length of said linkage means.

2. The apparatus of claim 1 wherein said means to pivot said linkage means includes a crank arm and an eccentric operably associated with said crank arm.

3. The apparatus of claim 2 wherein said eccentric is connected to a gear member and said means to pivot said linkage means includes a piston member operably associated with said gear member.

* * * * *